US010453432B2

(12) United States Patent
Lin et al.

(10) Patent No.: US 10,453,432 B2
(45) Date of Patent: Oct. 22, 2019

(54) DISPLAY ADJUSTMENT

(71) Applicant: Apple Inc., Cupertino, CA (US)

(72) Inventors: Hung Sheng Lin, San Jose, CA (US); Sun-Il Chang, San Jose, CA (US); Hyunwoo Nho, Stanford, CA (US); Jie Won Ryu, Sunnyvale, CA (US); Junhua Tan, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 53 days.

(21) Appl. No.: 15/699,460

(22) Filed: Sep. 8, 2017

(65) Prior Publication Data

US 2018/0090109 A1 Mar. 29, 2018

Related U.S. Application Data

(60) Provisional application No. 62/399,371, filed on Sep. 24, 2016.

(51) Int. Cl.

| | |
|---|---|
| ***G09G 5/393*** | (2006.01) |
| ***G09G 5/391*** | (2006.01) |
| ***G09G 3/20*** | (2006.01) |
| ***G09G 5/373*** | (2006.01) |

(52) U.S. Cl.

CPC ..... *G09G 5/391* (2013.01); *G09G 3/20* (2013.01); *G09G 3/2096* (2013.01); *G09G 5/373* (2013.01); *G09G 5/393* (2013.01); *G09G 2320/0233* (2013.01); *G09G 2320/0242* (2013.01); *G09G 2320/0252* (2013.01); *G09G 2320/0285* (2013.01); *G09G 2320/0295* (2013.01); *G09G 2320/041* (2013.01); *G09G 2320/043* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2004/0070558 | A1 | 4/2004 | Cok et al. | |
| 2005/0280766 | A1 | 12/2005 | Johnson et al. | |
| 2010/0045709 | A1 | 2/2010 | Nakamura et al. | |
| 2010/0123649 | A1 | 5/2010 | Hamer et al. | |
| 2013/0027383 | A1 * | 1/2013 | Odawara ..... | G09G 3/3233 345/212 |

(Continued)

FOREIGN PATENT DOCUMENTS

| | | |
|---|---|---|
| EP | 2642475 A1 | 9/2013 |
| WO | 2001063587 | 8/2001 |

OTHER PUBLICATIONS

International Search Report and Written Opinion for PCT Application No. PCT/US2017/050972 dated Nov. 23, 2017; 21 pgs.

*Primary Examiner* — Andrew G Yang

(74) *Attorney, Agent, or Firm* — Fletcher Yoder, P.C.

(57) ABSTRACT

An electronic device includes an electronic display, whereby the electronic display includes an active area that includes a pixel having a display behavior that varies with temperature. The electronic display also includes processing circuitry. The processing circuitry may, when in operation, generate image data to send to the pixel and adjust the image data to generate corrected image data based at least in part on a stored correction value for the pixel, wherein the stored correction value corresponds to an effect of temperature on the pixel.

20 Claims, 10 Drawing Sheets

(56) References Cited

U.S. PATENT DOCUMENTS

| | | | | |
|---|---|---|---|---|
| 2013/0113838 | A1* | 5/2013 | Ho | G09G 3/2003 345/690 |
| 2013/0120233 | A1 | 5/2013 | Jeon et al. | |
| 2013/0249932 | A1* | 9/2013 | Siotis | G09G 3/20 345/589 |
| 2014/0139570 | A1 | 5/2014 | Albrecht et al. | |
| 2015/0145896 | A1* | 5/2015 | Kim | G09G 3/003 345/690 |
| 2015/0228061 | A1* | 8/2015 | Shin | G06T 3/4015 382/167 |
| 2016/0027382 | A1 | 1/2016 | Chaji et al. | |
| 2016/0155377 | A1 | 6/2016 | Kishi | |
| 2016/0155384 | A1 | 6/2016 | Kim et al. | |
| 2017/0186369 | A1* | 6/2017 | Hayashi | G09G 3/3233 |
| 2017/0236490 | A1* | 8/2017 | Cheon | G09G 5/10 345/691 |

* cited by examiner

DISPLAY ADJUSTMENT

CROSS-REFERENCE TO RELATED APPLICATIONS

This application claims the benefit of Provisional Application Ser. No. 62/399,371, filed on Sep. 24, 2016 and entitled "Display Adjustment," which is incorporated by reference in its entirety.

BACKGROUND

The present disclosure relates to adjusting display of images on an electronic display based at least in part on sensed conditions affecting the electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices—such as televisions, portable phones, computers, vehicle dashboards, and more—include electronic displays. As electronic displays gain increasing higher resolutions and dynamic ranges, they also may become more susceptible to environmental changes, such as changes in temperature. Thermal variations (as well as other factors) that affect an electronic display can cause different pixels to exhibit different display behaviors. Accordingly, these variations may induce an undesirable lack of uniformity across the display, which may be perceived as differences in color representation across one or more portions of the display and/or luminance differences of the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Under certain conditions, non-uniformity of a display induced by process non-uniformity temperature gradients, or other factors across the display should be compensated for to increase performance of a display (e.g., reduce visible anomalies). The non-uniformity of pixels in a display may vary between devices of the same type (e.g., two similar phones, tablets, wearable devices, or the like), it can vary over time and usage (e.g., due to aging and/or degradation of the pixels or other components of the display), and/or it can vary with respect to temperatures, as well as in response to additional factors.

To avoid visual artifacts that could otherwise occur, techniques and systems outlined herein may be utilized in conjunction with an electronic display. In one example, an electronic device may store a prediction lookup table associated with independent heat-producing components of the electronic device that may create temperature variations on the electronic display. These heat-producing components could include, for example, a camera and its associated image signal processing (ISP) circuitry, wireless communication circuitry, data processing circuitry, and the like. Actual conditions of the electronic display may sensed and a correction lookup table may be established. Values from this lookup table may be added to image data to be displayed by the display as a correction factor to mitigate (e.g., compensate for) the impact of the sensed condition (e.g., thermal differences affecting the display).

Accordingly, this disclosure describes systems and techniques to provide an area based dynamic display uniformity correction that can be used to correct process, system, and/or environmental induced panel non-uniformities. This area based display uniformity correction can be applied at particular locations of the display or across the entirety of the display. In some embodiments, a lookup table of correction values may be a reduced resolution correction map to allow for reduced power consumption and increased response times. Additional techniques are disclosed to allow for dynamic and/or local adjustments of the resolution of the lookup table (e.g., a correction map), which also may be globally or locally updated based on real time measurements of the display, one or more system sensors, and/or virtual measurements of the display (e.g., estimates of temperatures affecting a display generated from measurements of power consumption, currents, voltages, or the like).

Additionally, per-pixel compensation may use large storage memory and computing power. Accordingly, reduced size representative values may be stored in a look-up table whereby the representative values subsequently may subsequently be decompressed, scaled, interpolated, or otherwise converted for application to input data of a pixel. Furthermore, the update rate for display image data and/or the lookup table may be variable or set at a preset rate. Dynamic reference voltages may also be applied to pixels of the display in conjunction with the corrective measures described above.

Additional compensation techniques related to adaptive correction of the display are also described. Pixel response (e.g., luminance and/or color) can vary due to component processing, temperature, usage, aging, and the like. In one embodiment, to compensate for non-uniform pixel response, a property of the pixel (e.g., a current or a voltage) may be measured and compared to a target value to generate correction value using estimated pixel response as a correction curve. However, mismatch between correction curve and actual pixel response due to panel variation, temperature, aging, and the like can cause correction error across the panel and can cause display artifacts, such as luminance disparities, color differences, flicker, and the like, to be present on the display.

Accordingly, pixel response to input values may be measured and checked for differences against a target response. Corrected input values may be transmitted to the pixel in response to any differences determined in the pixel response. The pixel response may be checked again and a second correction (e.g., an offset) may be additionally applied to insure that any residual errors are accounted for. The aforementioned correction values may supplement values transmitted to the pixel so that a target response of the pixel to an input is generated. This process may be done at an initial time (e.g., when the display is manufactured, when the device is powered on, etc.) and then repeated at one or more times to account for time-varying factors. In this manner, to accommodate for mismatches, a correction curve can be continuously monitored (or at predetermined intervals) in real time and adaptively adjusted on the fly to minimize correction error.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
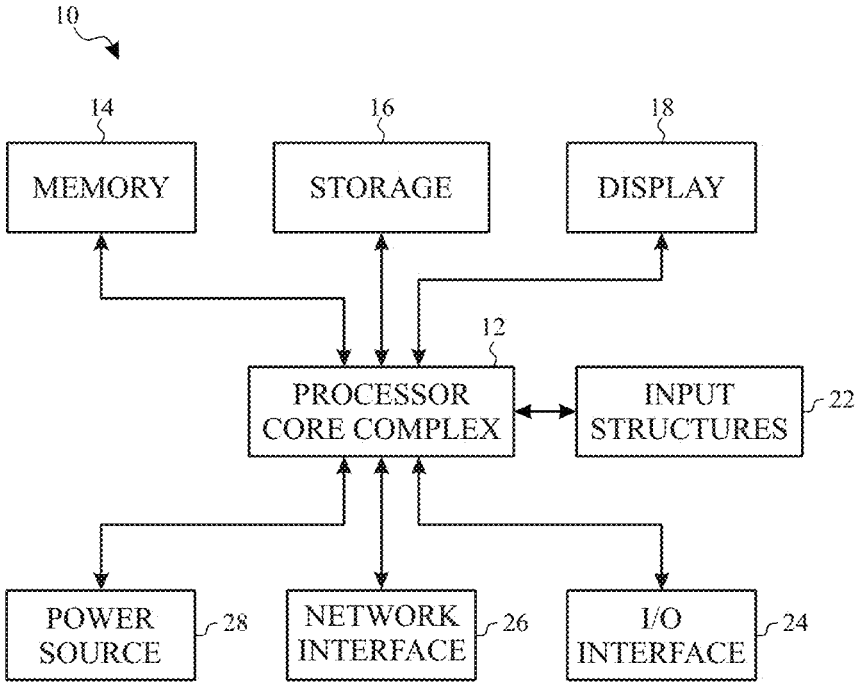
FIG. 1 is a schematic block diagram of an electronic device that performs display sensing and compensation, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

As noted above, display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. Accordingly, the techniques and systems described below may be utilized to compensate for the operational variations across the display.

Figure 2:
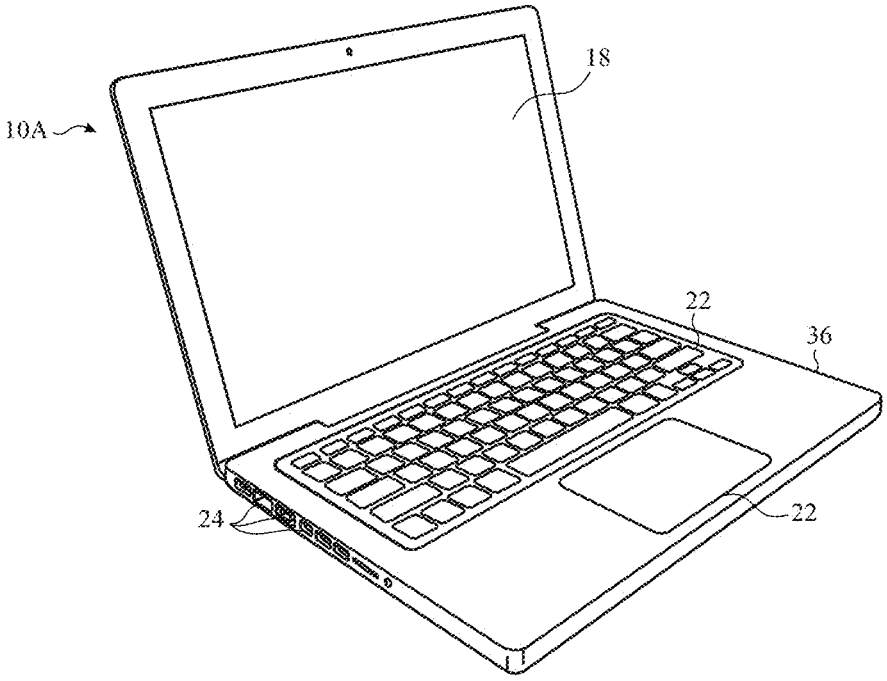
FIG. 2 is a perspective view of a notebook computer representing an embodiment of the electronic device of FIG. 1.
Figure 3:
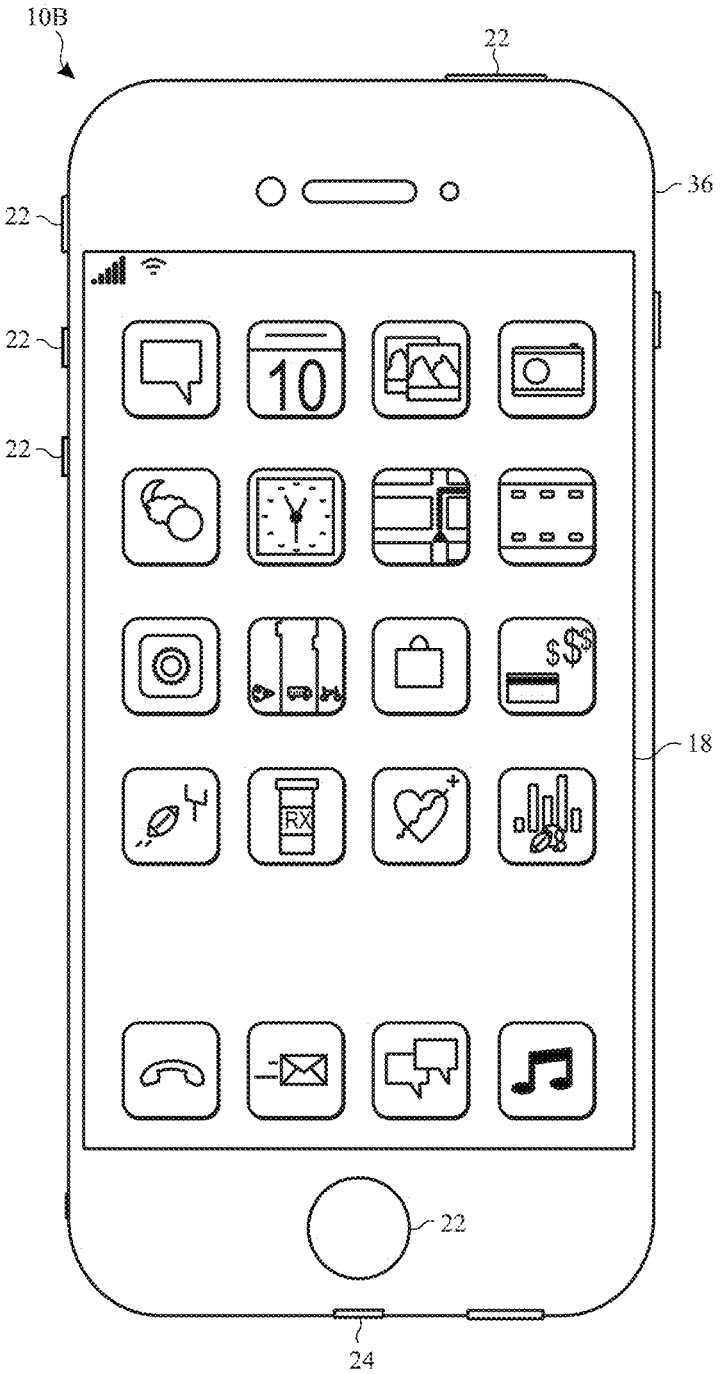
FIG. 3 is a front view of a hand-held device representing another embodiment of the electronic device of FIG. 1.
Figure 4:
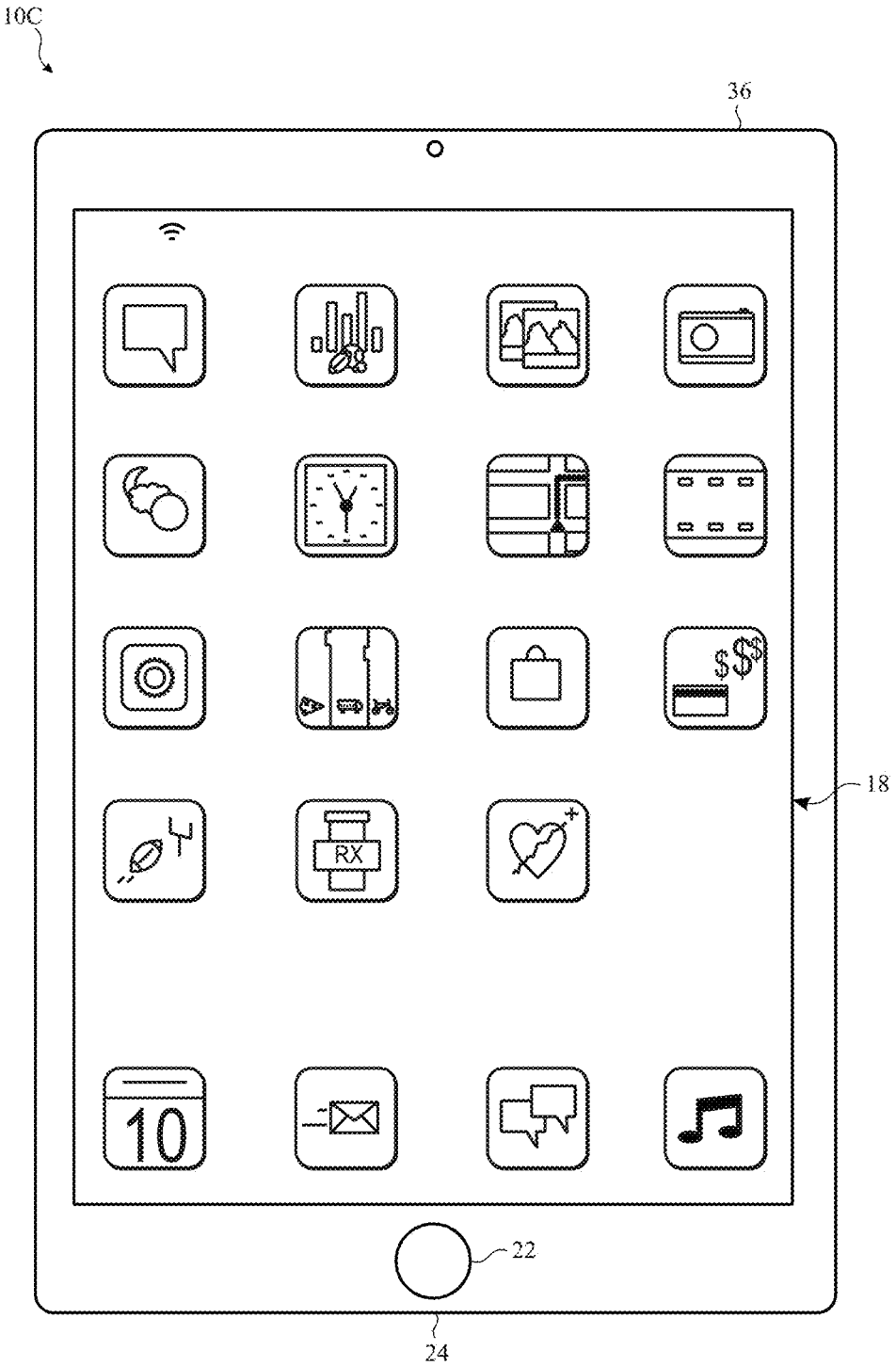
FIG. 4 is a front view of another hand-held device representing another embodiment of the electronic device of FIG. 1.
Figure 5:
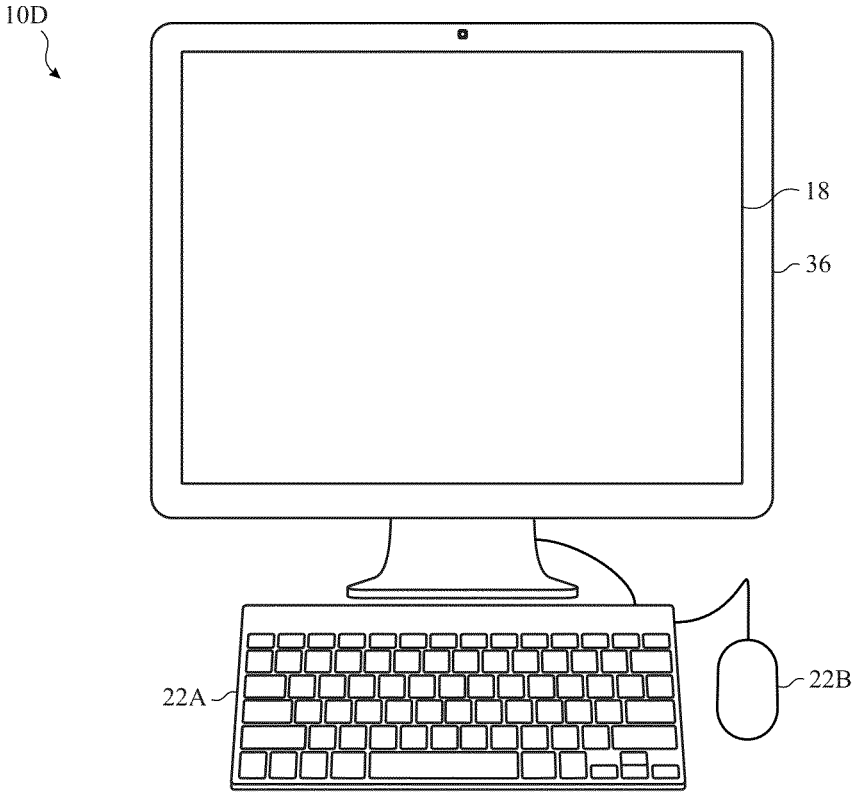
FIG. 5 is a front view of a desktop computer representing another embodiment of the electronic device of FIG. 1.
Figure 6:
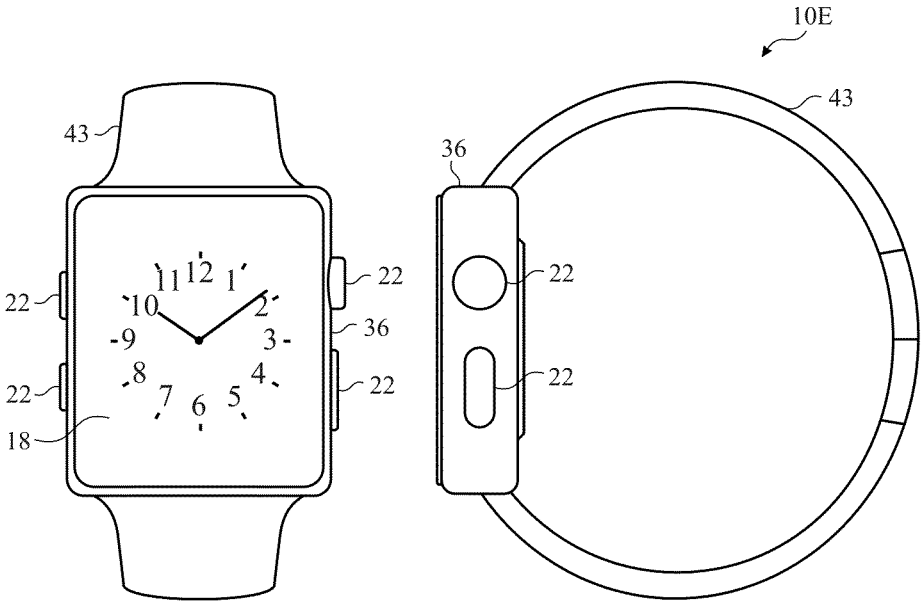
FIG. 6 is a front view and side view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
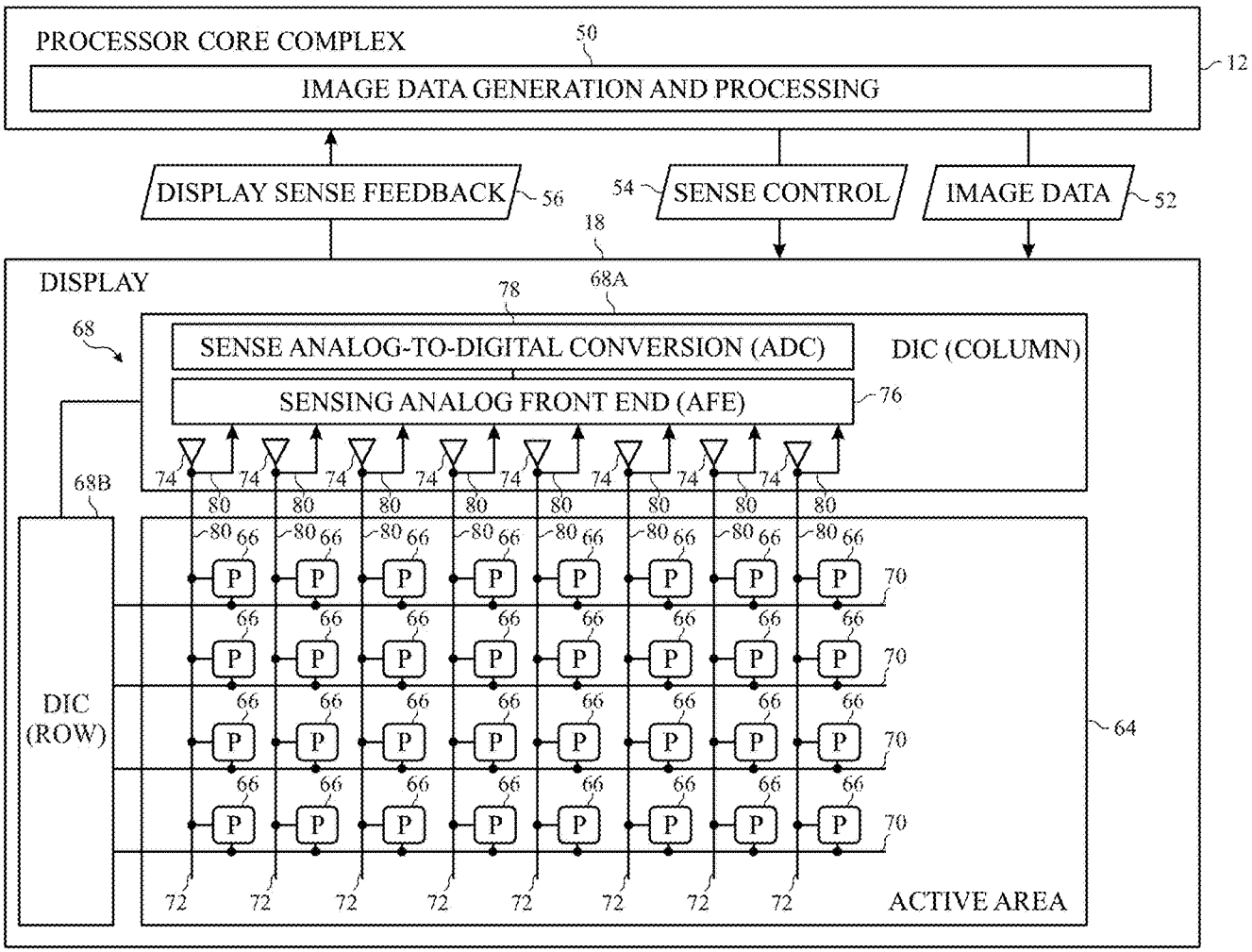
FIG. 7 is a block diagram of an electronic display that performs display panel sensing, in accordance with an embodiment.

As shown in FIG. 7, in the various embodiments of the electronic device 10, the processor core complex 12 may perform image data generation and processing 50 to generate image data 52 for display by the electronic display 18. The image data generation and processing 50 of the processor core complex 12 is meant to represent the various circuitry and processing that may be employed by the core processor 12 to generate the image data 52 and control the electronic display 18. Since this may include compensating the image data 52 based on manufacturing and/or operational variations of the electronic display 18, the processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing 50 into a compensation value that, when applied to the image data 52, appropriately compensates the image data 52 for the conditions of the electronic display 18. This results in greater fidelity of the image data 52, reducing or eliminating visual artifacts that would otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit 68, which may be a single module or may be made up of separate modules, such as a column driver integrated circuit 68A and a row driver integrated circuit 68B. The driver integrated circuit 68 (e.g., 68B) may send signals across gate lines 70 to cause a row of pixels 66 to become activated and programmable, at which point the driver integrated circuit 68 (e.g., 68A) may transmit image data signals across data lines 72 to program the pixels 66 to display a particular gray level (e.g., individual pixel brightness). By supplying different pixels 66 of different colors with image data to display different gray levels, full-color images may be programmed into the pixels 66. The image data may be driven to an active row of pixel 66 via source drivers 74, which are also sometimes referred to as column drivers.

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area of 64 of the electronic display 18, such as variations and temperature of the active area 64, as well as the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18.

Display panel sensing may be used to obtain the display sense feedback 56, which may enable the processor core complex 12 to generate compensated image data 52 to negate the effects of temperature, aging, and other variations of the active area 64. The driver integrated circuit 68 (e.g., 68A) may include a sensing analog front end (AFE) 76 to perform analog sensing of the response of pixels 66 to test data. The analog signal may be digitized by sensing analog-to-digital conversion circuitry (ADC) 78.

For example, to perform display panel sensing, the electronic display 18 may program one of the pixels 66 with test data. The sensing analog front end 76 then senses a sense line 80 of connected to the pixel 66 that is being tested. Here, the data lines 72 are shown to act as extensions of the sense lines 80 of the electronic display 18. In other embodiments, however, the display active area 64 may include other dedicated sense lines 80 or other lines of the display 18 may be used as sense lines 80 instead of the data lines 72. Other pixels 66 that have not been programmed with test data may be sensed at the same time a pixel that has been programmed with test data. Indeed, by sensing a reference signal on a sense line 80 when a pixel on that sense line 80 has not been programmed with test data, a common-mode noise reference value may be obtained. This reference signal can be removed from the signal from the test pixel that has been programmed with test data to reduce or eliminate common mode noise.

The analog signal may be digitized by the sensing analog-to-digital conversion circuitry 78. The sensing analog front end 76 and the sensing analog-to-digital conversion circuitry 78 may operate, in effect, as a single unit. The driver integrated circuit 68 (e.g., 68A) may also perform additional digital operations to generate the display feedback 56, such as digital filtering, adding, or subtracting, to generate the display feedback 56, or such processing may be performed by the processor core complex 12.

In some embodiments, a variety of sources can produce heat that could cause a visual artifact to appear on the electronic display 18 if the image data 52 is not compensated for the thermal variations on the electronic display 18. For example, as shown in a thermal diagram 90 of FIG. 8, the active area 64 of the electronic display 18 may be influenced by a number of different nearby heat sources. For example, the thermal map 90 illustrates the effect of at least one heat source that creates high local distribution of heat 92 on the active area 64. The heat source(s) that generate the distribution of heat 92 may be any heat-producing electronic component, such as the processor core complex 12, camera circuitry, or the like, that generate heat in a predictable pattern on the electronic display 18.

Figure 8:
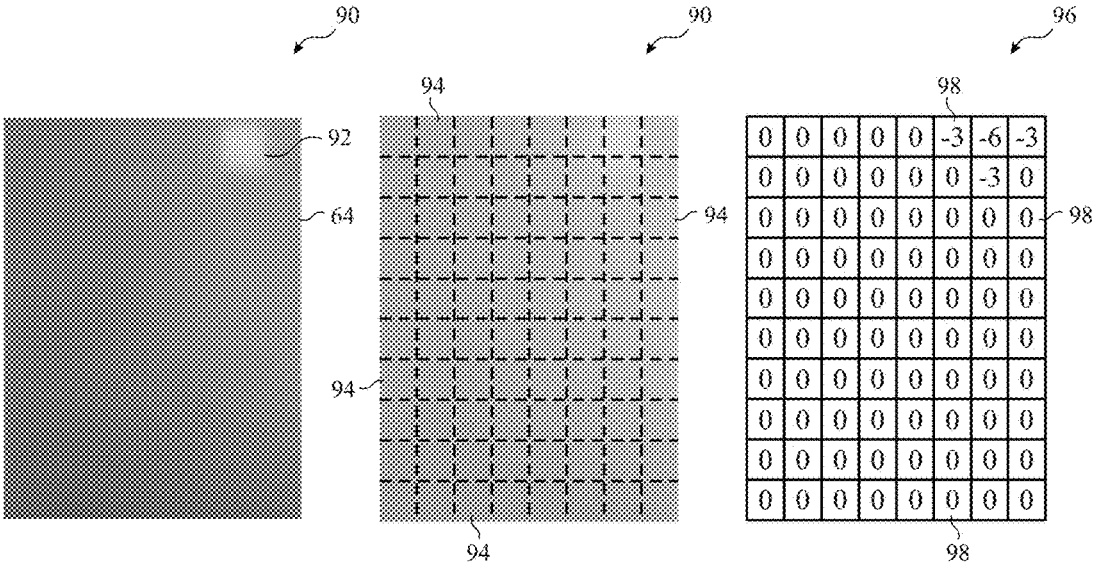
FIG. 8 is a thermal diagram indicating temperature variations due to heat sources on the electronic display, in accordance with an embodiment.

As further illustrated in FIG. 8, the thermal diagram 90 may be divided into regions 92 of the display 18 that each include a set of pixels 66. In this manner, groups of pixels 66 may be represented by the regions 92 such that attributes for a region 92 (e.g., temperatures affecting the region 92) may be attributed to a group of pixels 66 of that region 92. As will be discussed in greater detail below, grouping sensed attributes or influences of pixels 66 into regions 92 may allow for reduced memory requirements and processing when correcting for non-uniformity of the display 18. FIG. 8 additionally, shows an example of a correction map 96 that may include correction values 98 that correspond to the regions 92. For example, the correction values 98 may represent offsets or other values applied to image data being transmitted to the pixels 66 in a region 94 to correct, for example, for temperature differences at the display 18 or other characteristics affecting the uniformity of the display 18.

Figure 9:
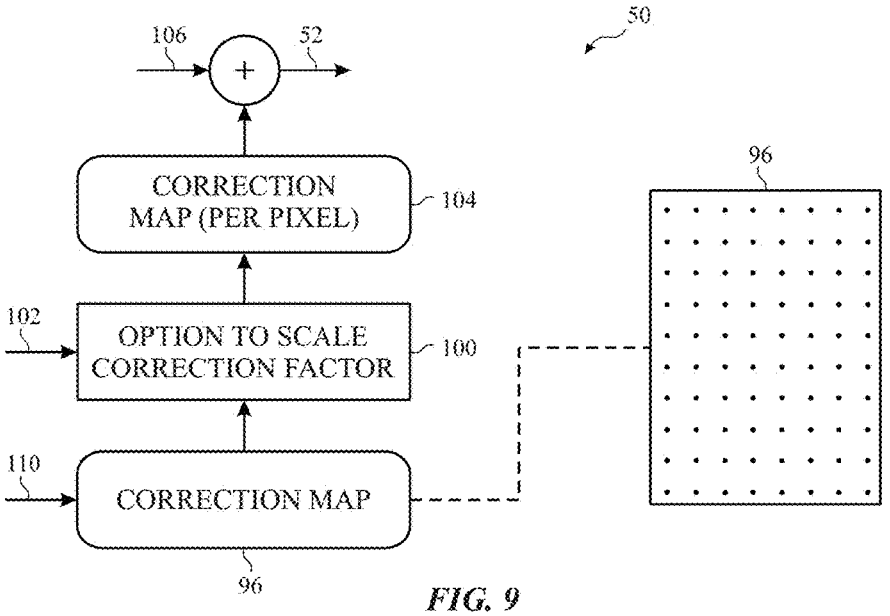
FIG. 9 is a block diagram of a process for compensating image data to account for changes sensed conditions affecting a pixel of the display of FIG. 7, in accordance with an embodiment.

As shown in FIG. 9, the effects of the variation and non-uniformity in the display 18 may be corrected using the image data generation and processing system 50 of the processor core complex 12. For example, the correction map 96 (which may correspond to a look up table having a set of correction values 98 that correspond to the regions 92) may be present in storage (e.g., memory) in the image data generation and processing system 50. This correction map 96 may, in some embodiments, correspond to the entire active area 64 of the display 18 or a sub-segment of the active area 64. As previously discussed, to reduce the size of the memory to store the correction map 96 (or the data therein), the correction map 96 may include correction values 98 that correspond to the regions 92. Additionally, in some embodiments, the correction map 96 may be a reduced resolution correction map that enables low power and fast response operations. For example, the image data generation and processing system 50 may reduce the resolution of the correction values 98 prior to their storage in memory so that less memory may be required, responses may be accelerated, and the like. Additionally, adjustment of the resolution of the correction map 96 may be dynamic and/or resolution of the correction map 96 may be locally adjusted (e.g., adjusted at particular locations corresponding to one or more regions 92).

The correction map 96 (or a portion thereof, for example, data corresponding to a particular region 92), may be read from the memory of the image data generation and processing system 50. The correction map 96 (e.g., one or more correction values) may then (optionally) be scaled (represented by step 100), whereby the scaling corresponds to (e.g., offsets or is the inverse of) a resolution reduction that was applied to the correction map 96. In some embodiments, whether this scaling is performed (and the level of scaling) may be based on one or more input signals 102 received as display settings and/or system information.

Figure 10:
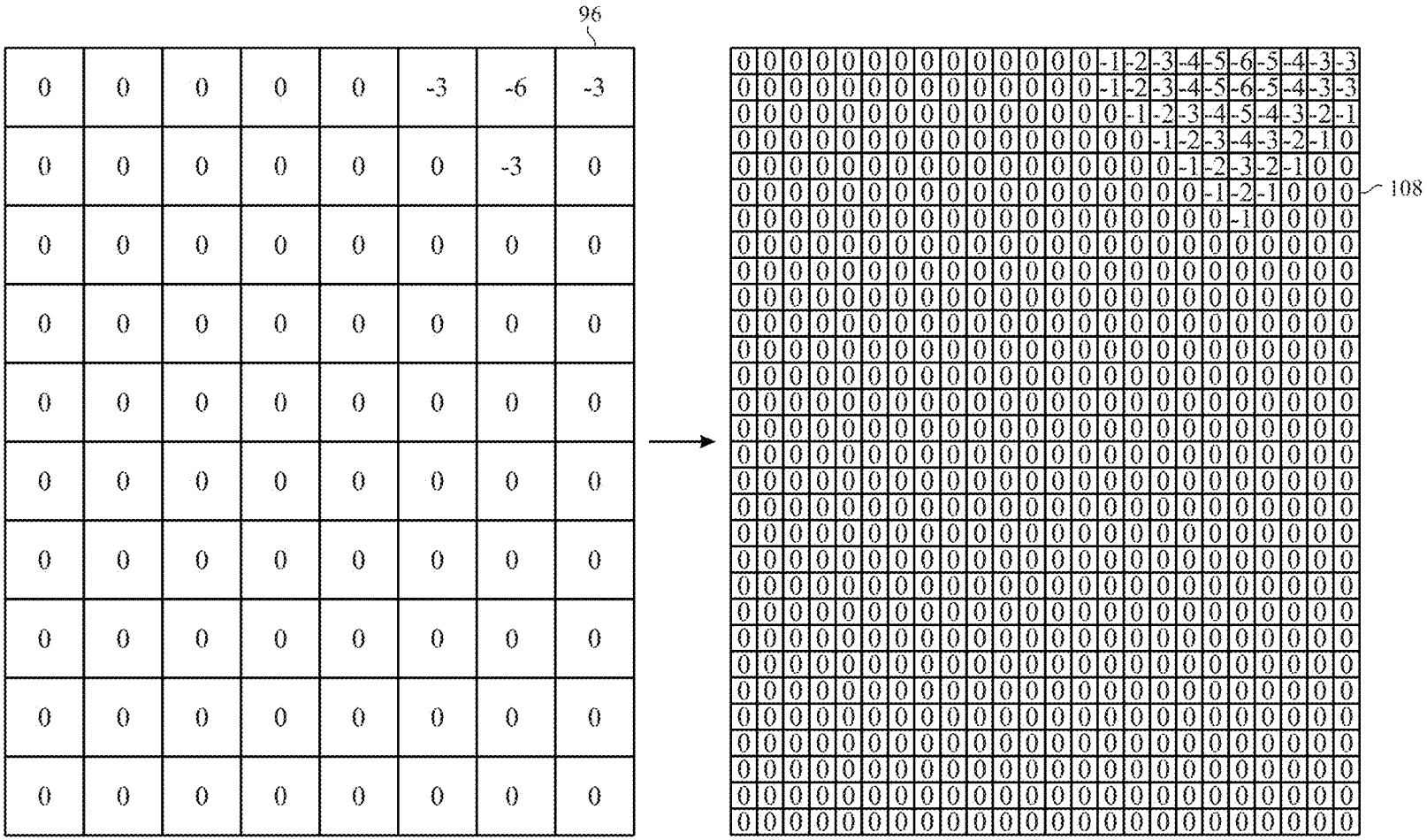
FIG. 10 is a representation of converting the data values of a correction map of FIG. 9, in accordance with an embodiment.

In step 104 conversion of the correction map 96 may be undertaken via interpolation (e.g., Gaussian, linear, cubic, or the like), extrapolation (e.g., linear, polynomial, or the like), or other conversion techniques being applied to the data of the correction map 96. This may allow for accounting of, for example, boundary conditions of the correction map 96 and may yield compensation driving data that may be applied to raw display content 106 (e.g., image data) so as to generate compensated image data 52 that is transmitted to the pixels 66. A visual example of this process of step 104 is illustrated in FIG. 10, which illustrates an example of converting the data values of correction map 96 into compensation driving data organized into a per pixel correction map 108 from the correction map 96.

Returning to FIG. 9, in some embodiments, the correction map 96 may be updated, for example, based on the input values 110 generated from the display sense feedback 56. This updating of the correction map 96 may be performed globally (e.g., affecting the entirety of the correction map 96) and/or locally (e.g., affecting less than the entirety of the correction map 96). The update may be based on real time measurements of the active area 64 of the electronic display 18, transmitted as display sense feedback 56. Additionally and/or alternatively, a variable update rate of correction can be chosen, e.g., by the image data generation and processing system 50, based on conditions affecting the display 18 (e.g., display 18 usage, power level of the device, environmental conditions, or the like).

Figure 11:
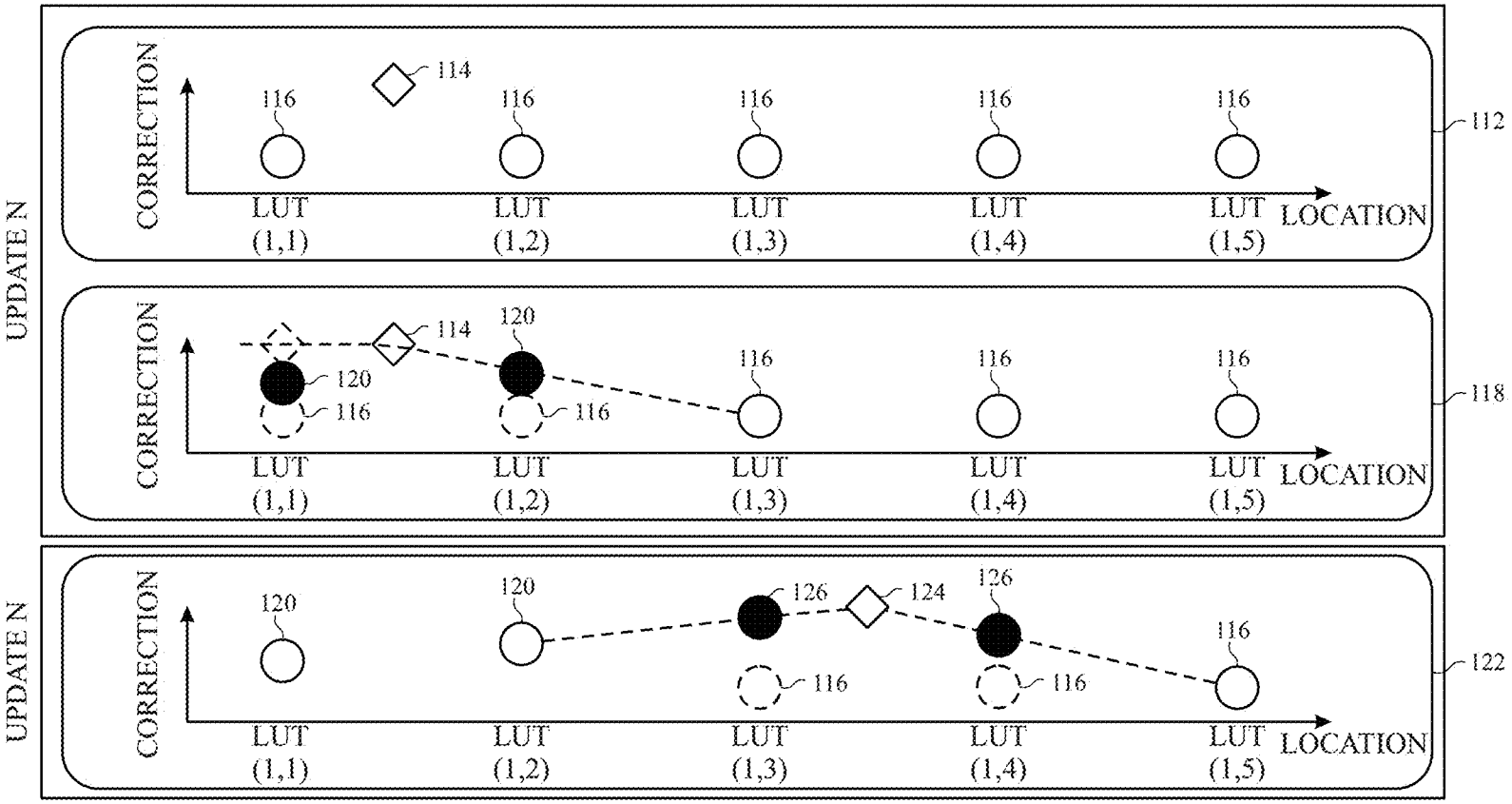
FIG. 11 is a graphical example of updating of the correction map of FIG. 9, in accordance with an embodiment.

FIG. 11 illustrates a graphical example of updating of the correction map 96. As shown in graph 112, a new data value 114 may be generated based on the display sense feedback 56 during an update at time n (corresponding to, for example, a first frame refresh). Also illustrated in graph 112 is the current look up table values 116 corresponding to particular row (e.g., row one) and column (e.g., columns one-five) pixel 66 locations. As part of the update of the correction map 96, as illustrated in graph 118, the new data value 114 may be applied to current look up table values 116 associated with (e.g., proximate to) the new data value 114. This results in shifting of the look up table values 116 corresponding to pixels 66 affected by the condition represented by the new data value 114 to generate corrected look up table values 120 (illustrated along with the former look up table values 116 that were adjusted).

As illustrated in graph 122, which represents an update at time n+1 (corresponding to, for example, a second frame refresh). An additional new data value data value 124 may be generated based on the display sense feedback 56 during an update at time n+1. As part of the update of the correction map 96, as illustrated in graph 118, the new data value 124 may be applied to current look up table values 116 associated with (e.g., proximate to) the new data value 124. This results in shifting of the look up table values 116 corresponding to pixels 66 affected by the condition represented by the new data value 124 to generate corrected look up table values 126 (illustrated along with the former look up table values 116 that were adjusted). The illustrated update process in FIG. 11 may represent a spatial interpolation example. However, it is understood that additional and/or alternative updating techniques may be applied to update the correction map 96.

In some embodiments, dynamic correction voltages may be provided to the pixels 66 singularly and/or globally. FIG.

12 illustrates an example of dynamic updating of voltage levels supplied to the pixels 66 and/or the active area 64. As illustrated in diagram 128, the image data generation and processing system 50 may receive display sense feedback 56 from, for example, one or more sensors 130. Also illustrated is a voltage change map 132 that may include updated voltage values generated by sensed conditions received from the one or more sensors 130. In some embodiments, the voltage change map 132 may be the correction map 96 discussed above.

Figure 12:
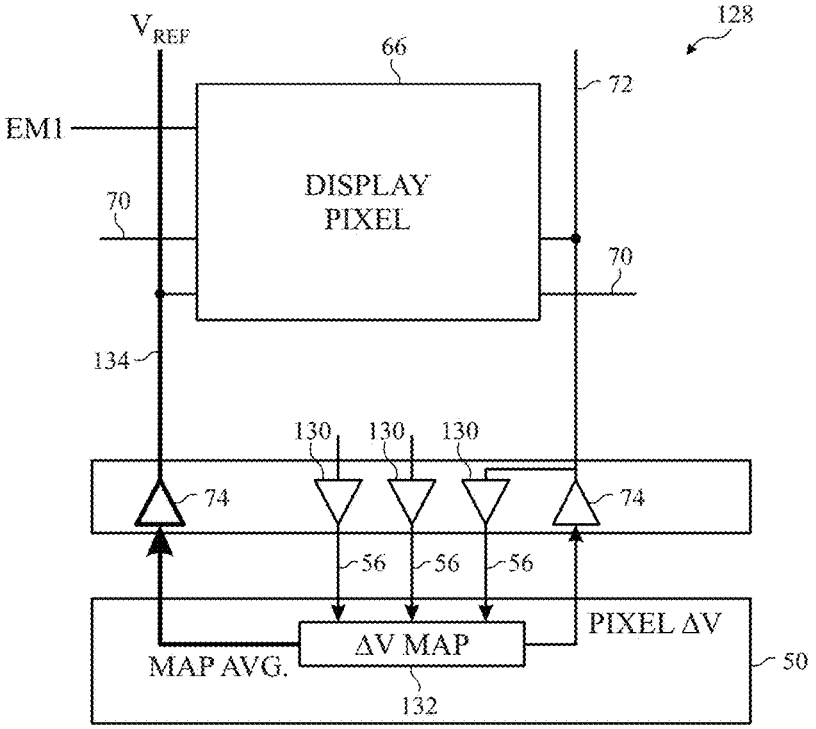
FIG. 12 is a diagram illustrating updating of voltage levels supplied to pixels of the display of FIG. 7, in accordance with an embodiment.

Some pixels 66 may use one terminal for image dependent voltage driving and a different terminal for global reference voltage driving. Accordingly, as illustrated in FIG. 12, common mode information (e.g., a correction map average of the overall voltage change map 132) can be used to update global driving voltage along reference voltage line 134. In this manner, for example, pixels of an active area 64 may adjusted together instead of individually (although individual adjustment would still be available via, for example, data lines 72).

Figure 13:
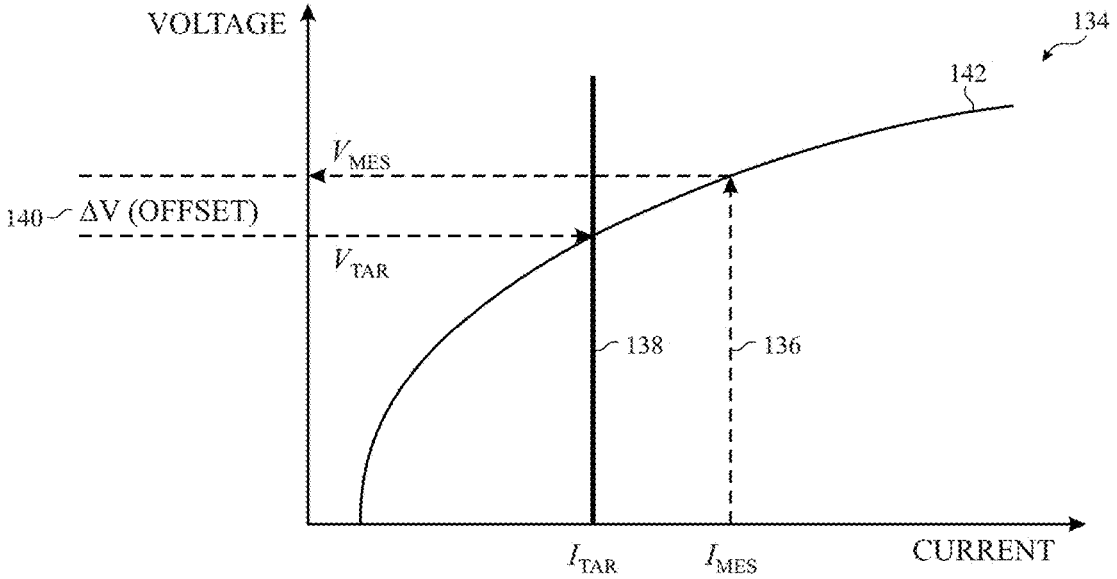
FIG. 13 is a graph illustrating a first embodiment of compensating for non-uniform pixel response of the display of FIG. 7, in accordance with an embodiment.

Other techniques for corrections of non-uniformity of a display are additionally contemplated. For example, as illustrated in graph 134 of FIG. 13, to compensate for non-uniform pixel response, a property of the pixel 66 (e.g., a current or a voltage) may be measured 136 and compared to a target value 138 to generate correction value 140 (e.g., an offset voltage) using an estimated pixel 66 response to generate a correction curve 142. This correction curve 142 may be used (e.g., in conjunction with a lookup table), for example to apply the correction value 140 to raw display content 106 (e.g., image data) so as to generate compensated image data 52 that is transmitted to the respective pixel 66 (e.g., the correction curve 142 may be used to choose offset voltages to be applied to the raw display content 106 based on a target current to be achieved). This process may be performed prior to or subsequent to the corrections discussed in conjunction with FIG. 9 (e.g., the corrected data generated based upon application of a particular value selected in conjunction with the correction curve 142 may be transmitted as the raw display content 106 of FIG. 9 or the compensated image data 52 of FIG. 9 may be corrected in conjunction with the correction curve 142 and subsequently transmitted to the pixel 66). However, mismatch between the correction curve 142 and actual pixel 66 response due to panel variation, temperature, aging, and the like can cause correction error across the active area 64 of pixels 66 and can cause display artifacts, such as luminance disparities, color differences, flicker, and the like, to be present on the display 18.

Figure 14:
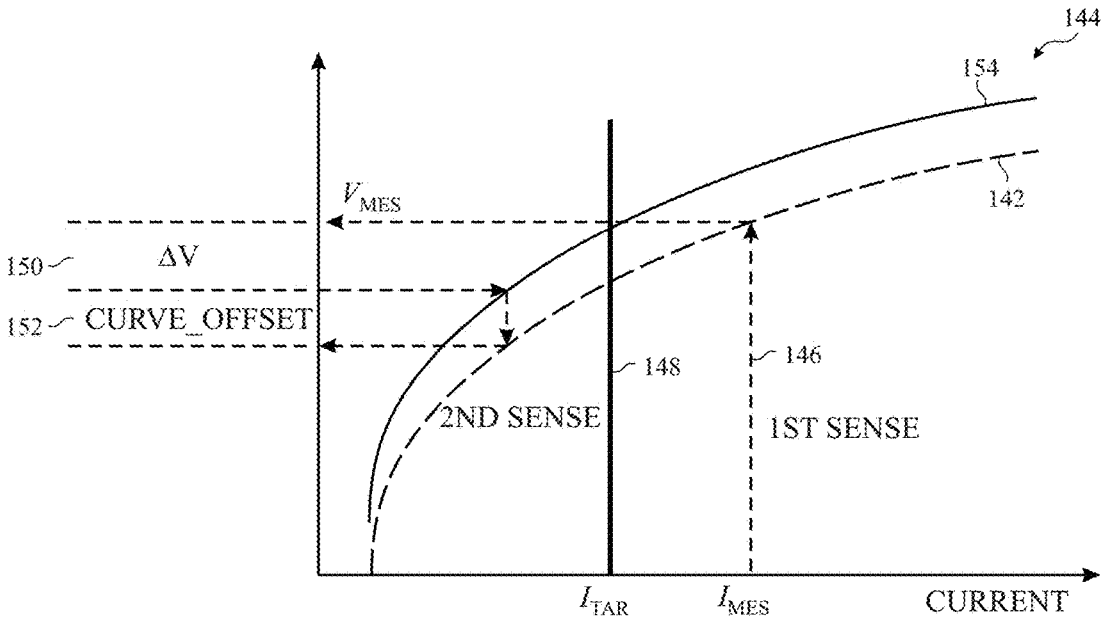
FIG. 14 is a graph illustrating a second embodiment of compensating for non-uniform pixel response of the display of FIG. 7, in accordance with an embodiment.

FIG. 14 illustrates a graph 144 that represents one technique to correct the correction curve 142 (e.g., to correct time-invariant curve mismatch, such as process variation). As illustrated in FIG. 14, a property of the pixel 66 (e.g., a current or a voltage) may be measured 146 and compared to a target value 148 to generate correction value 150 (e.g., an offset voltage) using a given correction curve 142 associated with the pixel 66. This correction value 150 may be applied to in a manner similar to that described above with respect to correction value 140.

Additionally, the property of the pixel 66 (e.g., a current a voltage) may be measured 152 at a second time, yielding a second measurement 146 that allows for residual correction (e.g., curve offset 152) to be additionally applied with the correction value 150 to generate a panel curve 154 that may be utilized (e.g., in conjunction with a lookup table) to apply the combined value of the correction value 150 and the curve offset 152 to, for example, raw display content 106 (e.g., image data) so as to generate compensated image data 52 that is transmitted to the pixels 66 (e.g., the panel curve 154 may be used to choose offset voltages to be applied to the raw display content 106 based on a target current to be achieved). This process may be performed prior to or subsequent to the corrections discussed in conjunction with FIG. 9 (e.g., the corrected data generated based upon application of a particular value selected in conjunction with the panel curve 154 may be transmitted as the raw display content 106 of FIG. 9 or the compensated image data 52 of FIG. 9 may be corrected in conjunction with the panel curve 154 and subsequently transmitted to the pixel 66). This process may be performed as an initial configuration of the device 10 (e.g., at the factory and/or during initial device 10 or display 18 testing) or may be dynamically performed (e.g., at predetermined intervals or in response to a condition, such as startup of the device).

Figure 15:
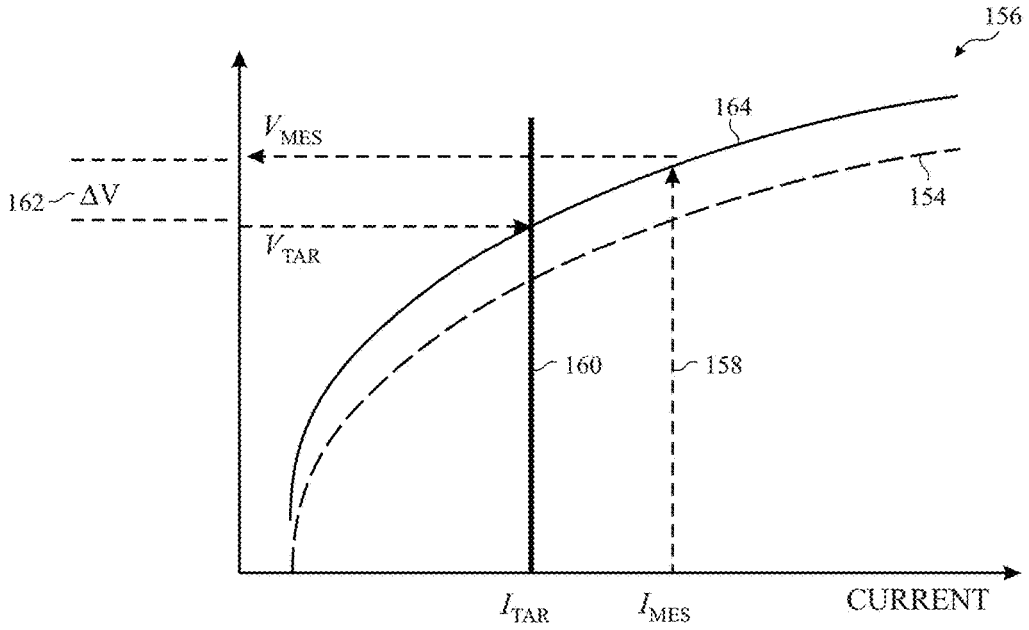
FIG. 15 is a graph illustrating a third embodiment of compensating for non-uniform pixel response of the display of FIG. 7.

FIG. 15 illustrates a graph 156 that represents a technique to correct the panel curve 154 (e.g., to correct time-variant curve mismatch caused by temperature, age, usage, or the like). As illustrated in FIG. 15, the panel curve 154 may be originally calculated (e.g., when the device 10 and/or display is first manufactured or tested) and stored. Likewise, the panel curve 154 may be calculated as described above with respect to FIG. 14 iteratively, for example, upon a power cycle of the device 10. Once the panel curve 154 is determined and the correction value 150 and the curve offset 152 are being applied to provide image data 52 (e.g., the panel curve 154 may be used to choose offset voltages to be applied to the raw display content 106 based on a target current to be achieved), an additional correction technique may be undertaken.

As illustrated in FIG. 15, a property of the pixel 66 (e.g., a current a voltage) may be measured 158 and compared to a target value 160 to generate correction value 162 (e.g., an offset voltage) that allows for further correction of the panel curve 154 correction values (e.g., the correction value 150 and the curve offset 152). This results in generation of an adapted panel curve 164 that may be utilized (e.g., in conjunction with a lookup table) to apply the combined value of the correction value 150, the curve offset 152, and the correction value 162 to, for example, raw display content 106 (e.g., image data) so as to generate compensated image data 52 that is transmitted to the pixels 66 (e.g., the adapted panel curve 164 may be used to choose offset voltages to be applied to the raw display content 106 based on a target current to be achieved). This process may be performed prior to or subsequent to the corrections discussed in conjunction with FIG. 9 (e.g., the corrected data generated based upon application of a particular value selected in conjunction with the adapted panel curve 164 may be transmitted as the raw display content 106 of FIG. 9 or the compensated image data 52 of FIG. 9 may be corrected in conjunction with adapted panel curve 164 and subsequently transmitted to the pixel 66).

The aforementioned described process may be performed on the fly (e.g., the panel curve 154 and/or the adapted panel curve 164 can be continuously monitored in real time and/or in near real time and adaptively adjusted on the fly to minimize correction error). Likewise, this process may be performed at regular intervals (e.g., in connection to the refresh rate of the display 18) to allows for enhancement correction accuracy for pixel 66 response estimation. In other embodiments, for example, in order to enhance curve adaptation further such as slope, the above adaptation procedure can be performed in multiple different current levels.

Furthermore, as each pixel 66 may have its own I-V curve, the above noted process may be done for each pixel 66 of the display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display comprising an active area comprising a pixel having a display behavior that varies with temperature; and processing circuitry configured to:

receive image data to send to the pixel;

adjust the image data to generate corrected image data based at least in part on a stored correction value for the pixel, wherein the stored correction value corresponds to an effect of measured temperature on the pixel; and adjust the corrected image data to generate additional corrected image data based at least in part on a second correction value, wherein the processing circuitry is configured to generate the second correction value by:

receiving an indication of a property of the pixel, wherein the property comprises a voltage or a current;

determining, using a correction curve associated with the pixel, a third correction value based at least in part on a difference between the indication of the property and a target indication of the property;

receiving a second indication of the property of the pixel;

updating the correction curve based at least in part on an offset between the first indication and the second indication to generate a panel curve associated with the pixel; and generating the second correction value using the panel curve, wherein the second correction value comprises the third correction value and the offset.

2. The electronic device of claim 1, wherein the processing circuitry is configured to transmit the additional corrected image data to the electronic display.

3. The electronic device of claim 2, wherein the electronic display is configured to utilize the additional corrected image data to drive the pixel.

4. The electronic device of claim 1, wherein processing circuitry is configured to generate the stored correction value.

5. The electronic device of claim 4, wherein processing circuitry is configured to generate the stored correction value based on a sensed condition affecting the pixel.

6. The electronic device of claim 5, wherein the electronic display is configured to sense the sensed condition affecting the pixel.

7. The electronic device of claim 6, wherein the electronic display is configured to sense a temperature generated by a heat producing component of the electronic device as the sensed condition affecting the pixel.

8. The electronic device of claim 4, wherein processing circuitry is configured to generate the stored correction value based upon a sensed condition affecting both the pixel and at least one additional pixel adjacent to the pixel.

9. The electronic device of claim 4, wherein processing circuitry is configured to generate the stored correction value as a reduced resolution version of a generated correction value for the pixel.

10. The electronic device of claim 9, wherein the processing circuitry is configured to scale the stored correction value to generate a scaled correction value.

11. The electronic device of claim 10, wherein the processing circuitry is configured to convert the scaled correction value to generate compensation driving data.

12. The electronic device of claim 11, wherein the processing circuitry is configured to convert the scaled correction value via interpolation of the scaled correction value.

13. The electronic device of claim 11, wherein the processing circuitry is configured to convert the scaled correction value via extrapolation of the scaled correction value.

14. The electronic device of claim 11, wherein the processing circuitry is configured to adjust the image data to generate corrected image data by applying the compensation driving data to the image data.

15. An electronic device comprising:

processing circuitry configured to:

receive a signal representative of a condition affecting a pixel of the electronic device at a first time;

generate a correction value based on the signal;

alter a resolution of the correction value to generate a reduced size correction value;

store the reduced size correction value in a storage device;

receive an indication of a property of the pixel, wherein the property comprises a voltage or a current;

determine, using a correction curve associated with the pixel, a correction value based at least in part on a difference between the indication of the property and a target indication of the property;

receive a second indication of the property of the pixel;

update the correction curve based at least in part on an offset between the first indication and the second indication to generate a panel curve associated with the pixel; and generate a second correction value using the panel curve, wherein the second correction value comprises the correction value and the offset.

16. The electronic device of claim 15, wherein the processing circuitry is configured to receive an input value representative of a condition affecting the pixel of the electronic device at a second time.

17. The electronic device of claim 16, wherein the processing circuitry is configured to update the reduced size correction value based on the input value.

18. An electronic device comprising:

an electronic display comprising an active area comprising a pixel; and processing circuitry configured to:

receive an indication of a property of the pixel, wherein the property comprises a voltage or a current;

determine, using a correction curve associated with the pixel, a correction value based at least in part on a difference between the indication of the property and a target indication of the property;

receive a second indication of the property of the pixel;

update the correction curve based at least in part on an offset between the first indication and the second indication to generate a panel curve associated with the pixel;

generate a second correction value using the panel curve, wherein the second correction value comprises the correction value and the offset; and apply the second correction value to image data transmitted to the pixel.

19. The electronic device of claim 18, wherein the processing circuitry is configured to:

receive a third indication of the property of the pixel;

update the panel curve based at least in part on an additional offset between the second indication and the third indication to generate an adapted panel curve associated with the pixel; and generate a third correction value using the adapted panel curve, wherein the third correction value comprises the second correction value and the additional offset.

20. The electronic device of claim 18, wherein the processing circuitry is configured to update the correction curve to generate the panel curve associated with the pixel upon startup of the electronic device.

* * * * *